US005141023A

United States Patent [19]

Dollison et al.

[11] Patent Number: 5,141,023

[45] Date of Patent: Aug. 25, 1992

[54] FLOW ACTUATED SAFETY VALVE

[75] Inventors: William W. Dollison, Dallas; John C. Gano, Carrollton, both of Tex.

[73] Assignee: Otis Engineering Corporation, Dallas, Tex.

[21] Appl. No.: 699,368

[22] Filed: May 13, 1991

[51] Int. Cl.[5] ..... F16K 17/24

[52] U.S. Cl. ..... 137/498; 137/519; 166/325

[58] Field of Search ..... 137/498, 519; 166/325

[56] References Cited

U.S. PATENT DOCUMENTS 2,122,080 6/1938 Wisdom ..... 137/498 X
2,411,667 11/1946 Mowrey ..... 137/498 X
2,447,546 8/1948 Spencer ..... 137/498 X

*Primary Examiner*—Robert G. Nilson
*Attorney, Agent, or Firm*—Roland O. Cox

[57] ABSTRACT

A retrievable subsurface safety valve positioned in a well conduit is actuated to close by a predetermined flow rate through the safety valve. A valve member having a sealing surface is moveable by flow to sealingly engage an annular seat in the valve, closing the valve to flow. All forms of the invention safety valve have retrievable variable weight assemblies which releasably lock in the valve member for varying the flow rate at which each valve closes. In two invention forms, the weight assemblies when retrieved from the valve members leave the valve members open for passage of well tools through the valve members. In one invention form, the valve housing has a variable bias for biasing the valve member toward open position and this safety valve may be operated to expend the seat, housing and valve member with or without the variable weight assembly.

25 Claims, 4 Drawing Sheets

FLOW ACTUATED SAFETY VALVE

BACKGROUND OF THE INVENTION (1) Technical Field

This invention pertains to safety valves useful to control flow in a well conduit. The invention particularly pertains to safety valves actuated to close by flow and having a retrievable weight assembly on which weight may be varied to change the closing flow rate of the safety valve.

(2) Background Information

Patents have been obtained for a member of safety valve structures actuated to close by flow. Examples are U.S. Pat. Nos. 3,070,119 and 3,603,394 to Raulins, 3,126,908 to Dickens, and 3,189,044 to Sizer. Each of these patented structures must be retrieved from the well or a well conduit to change the flow rate at which they are actuated to close.

SUMMARY OF THE INVENTION

The present invention presents a number of forms of a flow actuated safety valve each having a retrievable weight assembly which may be retrieved from the safety valve after it is installed in a well flow conduit to change flow rate at which the safety valve is actuated to close. Weight on the weight assembly may be changed after retrieval by adding or taking off weight to increase or decrease the closing flow rate.

An object of this invention is to provide a retrievable safety valve positionable in a well conduit wherein the valve member is moveable to sealingly engage an annular seat member closing the safety valve to flow by flow impingement on the valve member.

An object of this invention is to provide a retrievable safety valve actuated to close by flow having a retrievable variable weight assembly releasably locked in the valve element.

Another object of this invention is to provide a safety valve actuated by flow wherefrom a variable weight assembly may be retrieved and weight added or reduced to increase or decrease the flow rate at which the safety valve closes.

Another object of this invention is to provide a retrievable flow actuated safety valve for which the closing flow rate may be varied and when the variable weight assembly is retrieved, an open passage for well tools is provided through the valve member.

Another object of this invention is to provide a retrievable safety valve actuated by flow wherein the annular seat member is retrievable.

Also an object of this invention is to provide a retrievable safety valve actuated by flow having a retrievable valve member housing with a variable bias on the valve member housing biasing the valve member toward open position.

Also an object of this invention is to provide a retrievable safety valve with a variable bias on the valve member housing wherein the valve housing, valve member with or without weight assembly and annular seat may be disconnected for expending down the well conduit.

DESCRIPTION OF THE PREFERRED EMBODIMENTS

Figure 1:
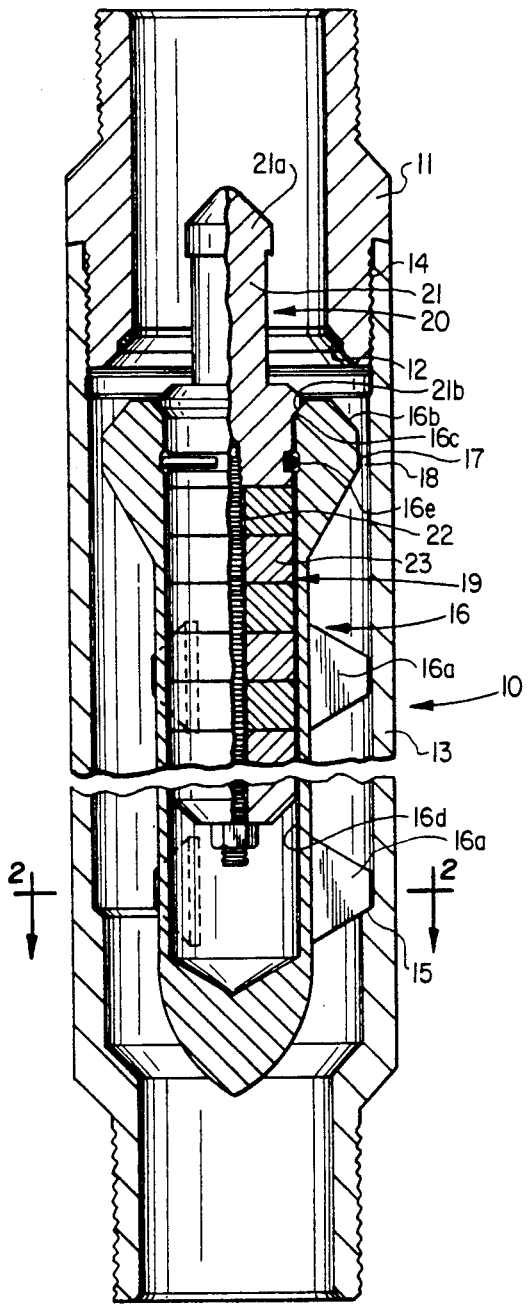
FIG. 1 is an elevational drawing in section showing one form of the safety valve of this invention open to upward flow.
Figure 2:
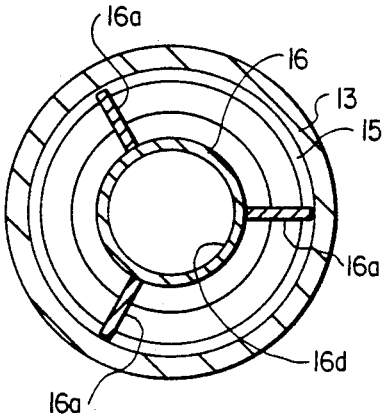
FIG. 2 is a drawing of a cross-section along line 2—2 of FIG. 1.

FIG. 1 shows one form 10 of the invention safety valve wherein the valve member is not open to flow when the variable weight assembly is retrieved. Valve 10 includes a connector 11 having an appropriate thread for connecting in a well conduit and an annular seat 12. A housing 13 is sealably connected to the connector at 14 and has an internal shoulder 15. A longitudinally moveable valve member 16 having a number of guides 16*a* (see also FIG. 2) is positioned in safety valve 10. The valve member includes a sealing surface 16*b*, a no-go landing surface 16*c*, a bore 16*d* which has a latching recess 16*e*. The valve member diameter at 17 establishes the size of annular area restriction 18 for flow between the valve member and housing. A retrievable variable weight member 19 has landed on surface 16*c* and is releasably latched in latching recess 16*e* in the bore. The weight member includes a latching mandrel 20 having a body 21 with fishing neck portion 21*a* for retrieving the weight member and a no-go locating surface 21*b* engageable with landing surface 16*c*. Connected to the latching body is a rod 22 on which are secured a number of weight discs 23. Any type latching or locking mandrel may be utilized on this weight member.

To use the safety valve of FIG. 1 for closure at a predetermined flow rate to prevent upward flow in a well conduit, safety valve 10 without retrievable variable weight member 19 is connected at the desirable level in a well conduit and the conduit lowered into the well. On surface, the proper amount of weight is secured on the variable weight member for valve closure at the desired flow rate and weight member 19 is lowered into the well conduit to land and latch in valve member 16. The weight of valve member 16 and weight member 19 will move the valve member to full open position where lower guides 16*a* contact housing shoulder 15. When the well conduit is opened for upward flow around valve member 16, through restriction 18 and between sealing surface 16*b* and annular seat 12, impingement on the projected area of the valve member diameter 17 and flow friction on the valve member will urge valve member seal surface 16*b* toward annular seat 12. When the flow rate increases to the closing rate, the flow stream will lift valve member 16 to sealingly engage annular seat 12 closing the safety valve and well conduit upward flow. The valve will automatically reopen on equalizing the pressure above and below the annular seat. If it is desirable to change the flow rate at which the valve closes, weight member 19 is retrieved back to surface and the number weight discs 23 is increased or decreased as required. The weight member is then lowered in the well conduit to land and relatch in the safety valve member. The safety valve closing flow rate may be changed as often as required without retrieving the safety valve from a well.

Figure 3:
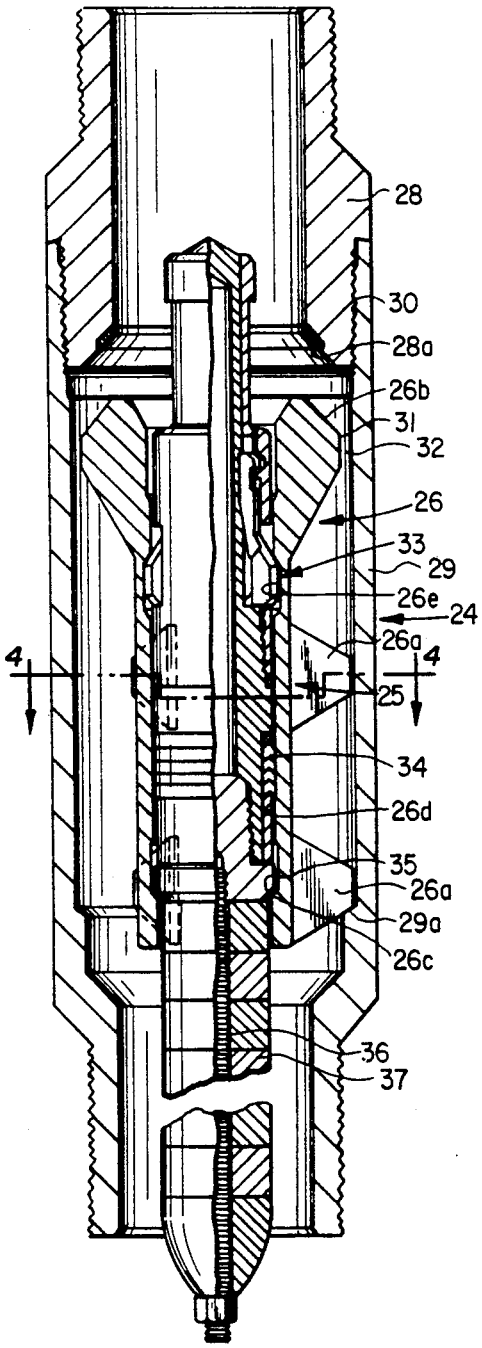
FIG. 3 is an elevational drawing in section showing another form of the invention safety valve open to flow.
Figure 4:
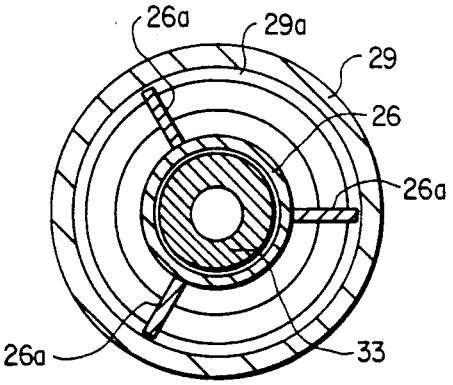
FIG. 4 is a cross-sectional drawing along line 3—3 of the safety valve of FIG. 2 from which the retrievable variable weight member has been retrieved.
Figure 5:
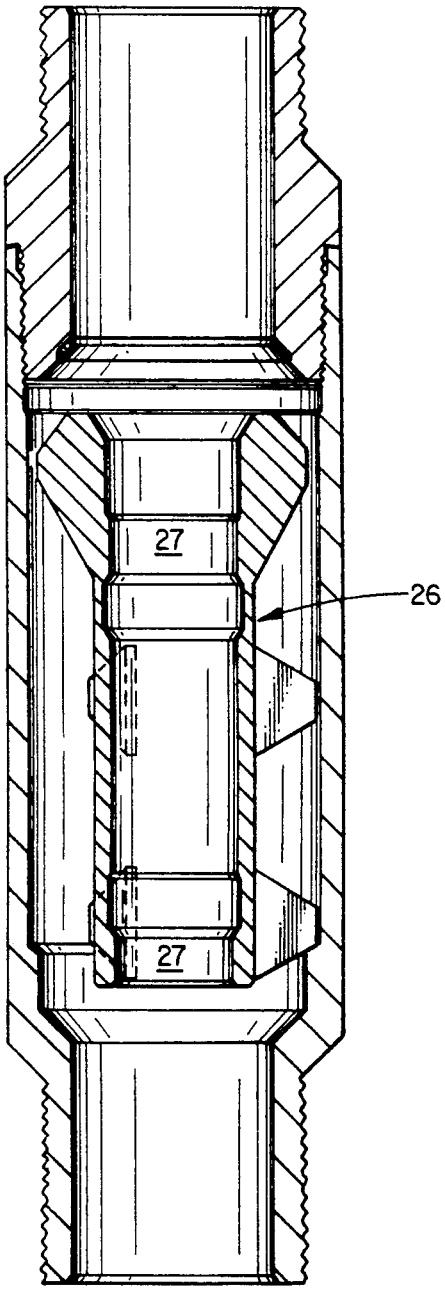
FIG. 5 is a sectioned drawing in elevation showing the safety valve of FIG. 3 from which the variable weight assembly has been retrieved.

Another form of the invention safety valve 24 is shown in FIG. 3 wherein the closing flow rate may be changed without retrieving the safety valve from a well. When the variable weight member 25 is retrieved from valve member 26 in this valve, a full open passage 27 is provided for passage of well tools through the valve member (see FIG. 4). Valve 24 includes a connector 28 having an annular seat 28*a*. The connector is sealably connected to a housing 29, having an internal shoulder 29*a*, by connection 30. The connector and housing have appropriate connections for connecting into a well conduit. The valve member 26 is longitudinally moveable and has a number of guides 26*a* (see also FIG. 4), a sealing surface 26*b*, a no-go landing surface 26*c* and a seal bore 26*d*, which has a locking recess 26*e*. The valve member diameter at 31 establishes the size of the annular area (restriction) 32 for flow between the valve member and housing. As shown in FIG. 3, the retrievable variable weight member 25 has a locking mandrel 33 with seals 34 and a no-go locating shoulder 35. Various forms of locking mandrels with seals may be in weight member 25. Connected to the locking mandrel is a rod 36 on which are secured a number of weight discs 37. Weight member locating shoulder 35 has landed on valve member surface 26*c*, seals 34 have sealingly engaged valve member sealing surface 26*d* and locking mandrel 33 has releasably locked in locking recess 26*e*. Please note the weight member may be installed in the safety valve on surface and "run in place" or installed in the safety valve after it is positioned in the well.

To use the safety valve of FIG. 3 for closure at a predetermined flow rate to prevent upward flow in a well conduit, safety valve 24 with or without weight member 25 is connected at the desired level in a well conduit and the conduit lowered into the well. If the weight member was not run in place, the proper amount of weight is secured on the weight member for valve closure at the desired flow rate and weight member 25 is lowered into the well conduit to land, seal and lock in valve member 26. The weight of the valve member and weight member will move the valve member to full open position where lower guides 26*a* contact housing shoulder 29*d*. When the well conduit is opened for upward flow around valve member 26, through restriction 32 and between sealing surface 26*b* and annular seat 28*a*, flow impingement on the projected area of the valve member diameter 31 and flow friction on the weight and valve members will urge valve member seal surface 26*b* toward annular seat 28*a*. As the flow rate increases to the closing rate, the flow stream will lift valve member 26 to sealingly engage seat 28*a* closing the safety valve and well conduit to upward flow. If the flow rate at which the safety valve closes requires changing, weight member 25 is retrieved back to surface and the number of weight discs 37 is increased or decreased as required. The weight member is then lowered in the well conduit to land and relock in the safety valve member. The safety valve closing flow rate may be changed as often as required without retrieving the safety valve from a well.

Figure 6A:
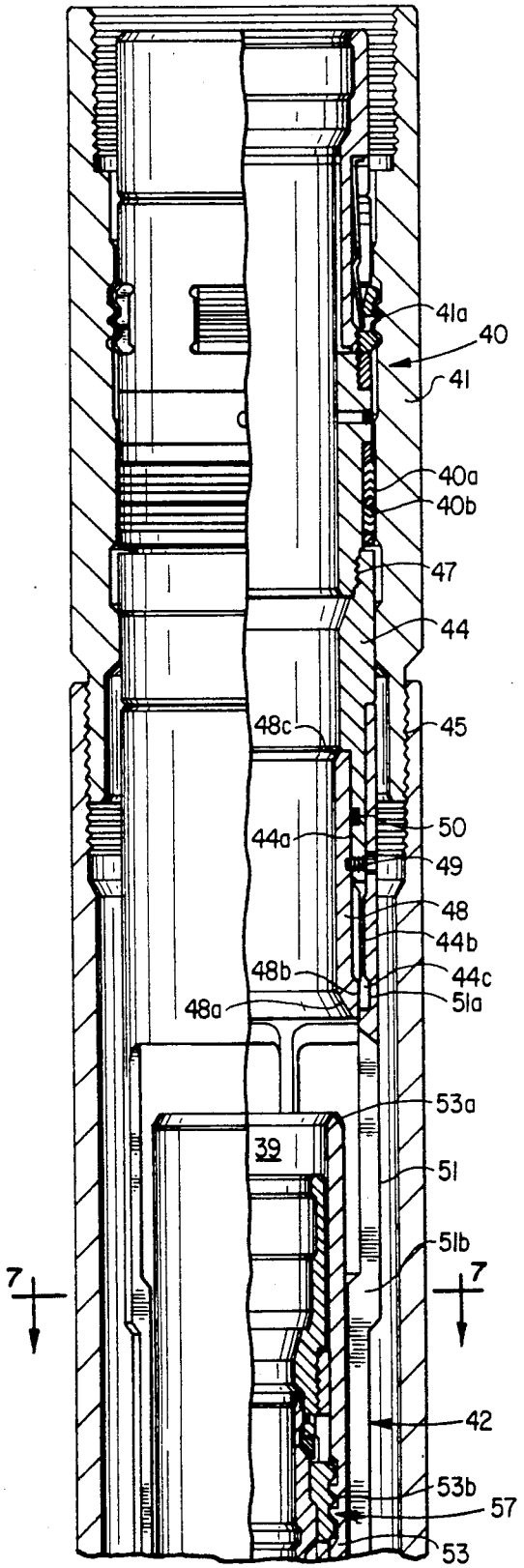
FIGS. 6A and 6B together is a partially sectioned elevational drawing showing a well system using another form of the safety valve of this invention.
Figure 6B:
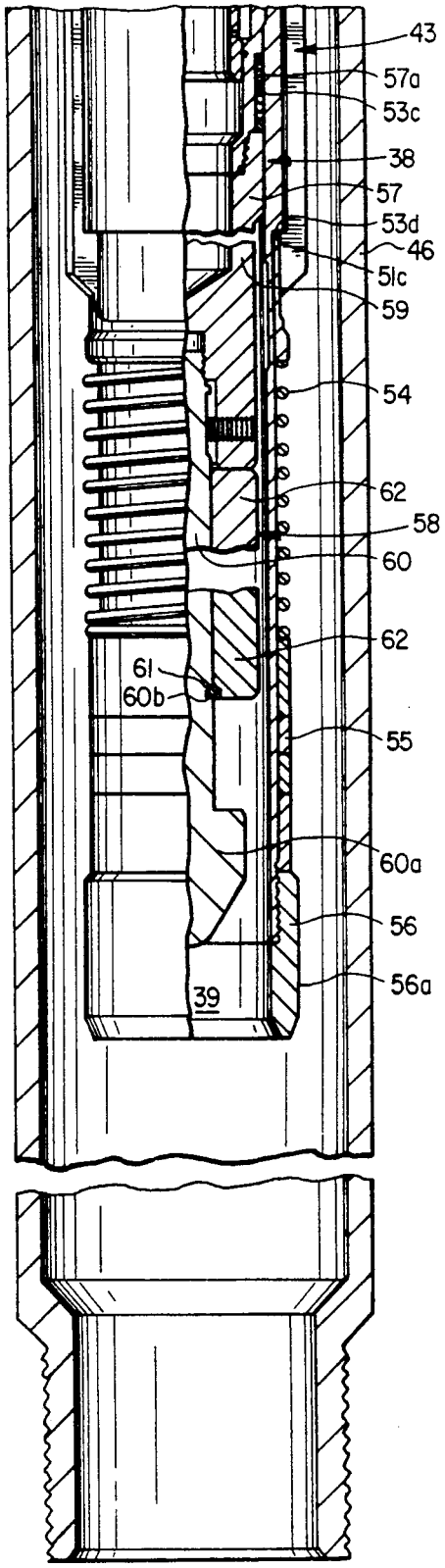

Yet another form of the invention safety valve wherein the closing flow rate may be varied without retrieving the safety valve from a well is shown being utilized in the safety system for controlling flow in a well conduit depicted in FIG. 6. When variable weight member 38 is retrieved from this safety valve, a full open passage 39 is provided for passage of well tools. Lock mandrel 40 may be installed in and retrieved from a landing nipple 41, in the well conduit. After installation and operation, this safety valve may be operated to disconnect the valve housing 42, carrying valve assembly 43, from connector 44 for expending down the well conduit along with slidable seat 48.

Landing nipple 41 has an upper appropriate connection for connecting in a well conduit, locking recesses 41*a* and a seal bore 41*b*. Retrievable lock mandrel 40 has seals 40*a* and these seals have been sealingly engaged in nipple seal bore 41*b* and the lock mandrel has been locked in locking recesses 41*a*. Any appropriate form of lock mandrel may be used which will sealingly engage and lock in a landing nipple. Connected to the landing nipple at 45 is conduit nipple 46. Connector 44 is connected to lock mandrel 40 at 47. A slidable seat 48, having a sealing surface 48*a*, an expanding surface 48*b* and a shoulder 48*c*, is releasably positioned in connector bore 44*a* by shearable pin 49 and sealed to the connector by resilient seal 50. The lower end of the connector 44 is provided with a number of collet fingers 44*b* each having a lug 44*c*.

Figure 7:
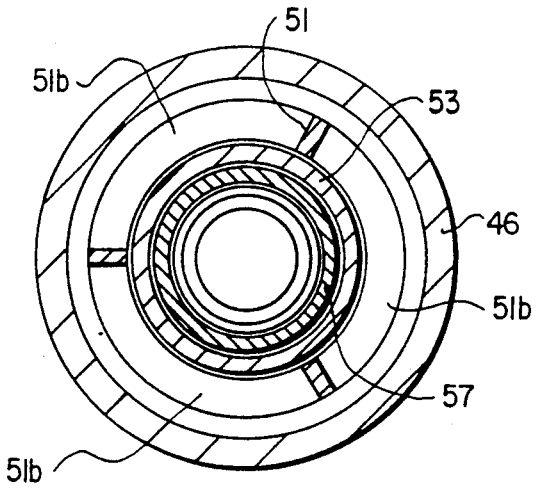
FIG. 7 is a drawing in cross-section along line 7—7 of FIG. 6.

Valve housing assembly 42 includes a tubular housing 51 having a groove 51*a* and a number of openings for flow 51*b* (see also FIG. 7) and an internal shoulder 51*c*. Collet fingers 44*b* are held expanded by surface 48*b* engaging lugs 44*c* in groove 51*a* and connecting tubular housing 51 to connector 44.

Slidably mounted in the tubular housing is the valve assembly 43 having a valve member 53 which has a sealing surface 53*a* engageable with seat sealing surface 48*a*. The valve member includes internal locking recesses 53*b*, a seal bore 53*c* and a shoulder 53*d*. Biasing means around the valve member, which biases the valve member toward open position and shoulder 53*d* in contact with shoulder 51*c*, includes a spring 54 and a number of spacers 55. A guide 56 connected to valve member 53 retains the spring and spacers around and between valve member 53 and tubular housing 51. The diameter 56*a* of the guide determines the area of flow restriction between the outside of the guide and inside of the conduit nipple 46 and through the safety valve.

Weight member assembly 38 is provided With a lock mandrel 57 having seals 57*a* and a variable weight assembly 58, suspended from the lock mandrel by connector 59. Any appropriate form of lock mandrel may be utilized in this weight member assembly. The weight assembly includes a rod 60 having a guide portion 60*a* and a number of grooves 60*b*. Secured on the rod by a split ring 61 are a number of weight discs 62. The weight member assembly has been lowered into the well conduit, safety valve and valve member. Seals 57*a* have sealingly engaged valve member seal bore 53*c* and the lock mandrel has been operated to releasably lock in locking recesses 53*b*, suspending the weight assembly from valve member 53.

To install and use the safety valve system of FIG. 6, landing nipple 41 is connected to conduit nipple 46 and both nipples are connected at the proper level in the well conduit as the conduit is run into the well. Calculations are made based on well capabilities and flow rate at which the safety valve is to close to determine the rate of spring 54 and/or the number of spacers 55 required to bias the valve assembly 43 to open position in tubular housing 51. Spring 54 of a desired rate and spacers 55 as required are secured around valve member 53 by connecting guide 56. The proper number of weight discs 62 are calculated and secured on rod 60 of variable weight member 38. The weight member may be installed in valve member 53 of Valve assembly 43 on surface and be installed in the safety valve system when lock mandrel 40 is installed in landing nipple 41. Alternatively, the weight member may be releasably installed in the valve member after lock mandrel 40 is installed in landing nipple 41.

Next, lock mandrel 40 carrying safety valve of FIG. 6 with or without the weight member is lowered in the well conduit and landing nipple 41 where lock mandrel 40 sealingly engages nipple seal bore 41*b* and is operated to releasably lock in recesses 41*a*. If not previously installed in valve member 53, weight member 38 is lowered into the well conduit, safety valve and valve member where lock mandrel 57 sealingly engages seal bore 53*c* and the lock mandrel is operated to releasably lock in recesses 53*b*.

When the well conduit is opened for flow upward through the restricted area around guide 56, openings 51*b*, seat 48 and lock mandrel 40 to surface from the producing formation, flow friction and flow will impinge on the projected area of diameter 56*a* of guide 56 and produce a force urging the weight member assembly and valve member upwardly. The force urging the valve to close is opposed by the weight of the weight member and compression resistance of spring 54. When the flow rate increases to the closing rate, the weight member assembly and valve member are moved upwardly to sealingly engage valve member seal surface 53*a* with seat member seal surface 48*a*, closing the valve and conduit to flow. The valve will automatically return to open position on application of sufficient pressure in the well conduit above the closed safety valve.

Like the safety valves of FIGS. 1 and 3, if production capabilities of the well change and a change in the flow rate causing the safety valve to close is required, variable weight assembly 38 may be retrieved to surface and the number of weight discs 62 may be increased or decreased on the weight assembly for safety valve closure at the new flow rate. The weight assembly is then lowered to and relocked in the valve member.

Figure 8:
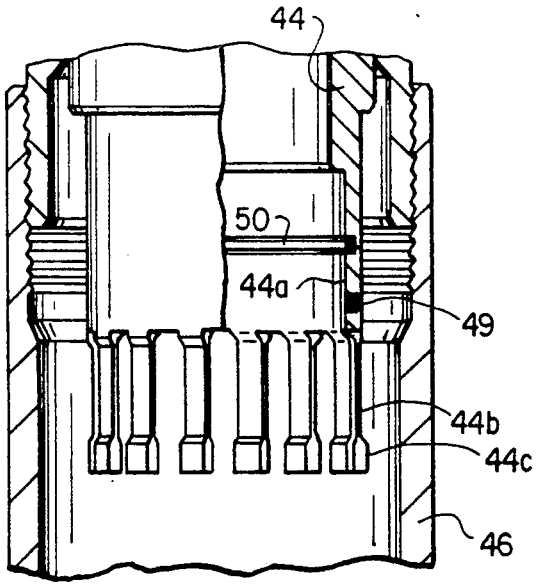
FIG. 8 is a drawing showing a portion of safety valve used in the system of FIG. 6. The safety valve has been operated too expend the valve seat, valve member and valve housing.

The safety valve of FIG. 6 may be operated to disconnect tubular housing 51 from connector 44 to expend seat 48, the tubular housing and valve assembly 43 (with or without weight member 38) to bottom in the well conduit. The application of sufficient force on shoulder 48*c* in seat 48 will shear pin 49 and move the seat and expanding surface 48*b* from inside collet fingers 44*b* permitting finger lugs 44*c* to be cammed inwardly from tubular housing groove 51*a* by the weight of housing 51 and the weight supported by this housing. After disconnecting and expending seat 48 and housing 51 as shown in FIG. 8, full opening for passage through landing nipple 41 and conduit nipple 46 may be provided by unlocking and retrieving lock mandrel 40 and connector 44 back to surface.

What we claim as our invention is:

1. A retrievable subsurface safety valve comprising:

(a) housing means for connecting said safety valve in a flow conduit; and (b) valve means in said housing for controlling flow from outside to inside said safety valve, said valve means including:

an annular seat member in said housing and valve member means having a valve member with a sealing surface thereon and locking recesses therein, said valve member moveable by flow to sealingly engage said valve member sealing surface with said seat member preventing flow from outside to inside said valve, said valve member having retrievable weight member means therein for predetermining the flow rate at which said valve member sealingly engages said seat member, said weight member means including a lock mandrel for releasably locking in said valve member locking recesses.

2. The safety valve of claim 1 wherein the valve member is open for passage of well tools therethrough on unlocking and retrieval of the weight member means.

3. The subsurface safety valve of claim 2 wherein the valve member further includes a number of guides connected on said valve member.

4. The subsurface safety valve of claim 1 wherein the housing means comprises:

(a) a tubular housing connectible in a flow conduit; and (b) a connector sealably connected in the upper end of said lower housing, said connector connectible in a flow conduit.

5. The subsurface safety valve of claim 1 wherein the valve member includes a no-go landing shoulder, and a bore with locking recesses therein, said valve member not having a flow passage therethrough, said retrievable weight member means comprising:

(a) locking means for locating on said no-go landing shoulder and releasably locking in said valve member locking recesses; and (b) a number of weights connected on said locking means.

6. The subsurface safety valve of claim 2 wherein the valve member has a flow passage therethrough, a no-go landing shoulder, locking recesses and a seal bore in said flow passage, said retrievable weight member means comprising:

(a) locking means for releasably locking in said valve member locking recesses and sealing in said seal bore, said locking means having a no-go locating surface engageable with said no-go landing shoulder and seals thereon, said seals sealingly engageable in said valve member seal bore closing said flow passage to flow; and (b) a number of weights connected on said locking means.

7. The subsurface safety valve of claim 5 wherein the valve member further includes a number of guides connected on said valve member.

8. The subsurface safety valve of claim 6 wherein the lower housing has an internal shoulder therein engageable by the valve member guides.

9. The subsurface safety valve of claim 7 wherein the lower housing has an internal shoulder therein engageable by the valve member guides.

10. The subsurface safety valve as defined in claim 1 wherein the housing means comprises:

(a) a lower tubular housing having openings through the wall thereof, and an internal shoulder therein;
(b) an upper housing having an appropriate connection thereon;
(c) a seat member releasably positioned in said upper housing; and
(d) means for positioning said seat member in said upper housing.

11. The subsurface safety valve of claim 10 wherein the means releasably positioning the seat member in the upper housing is a shearable pin installed in said upper housing and protruding into said seat member.

12. The subsurface safety valve of claim 10 further including means releasably connecting said lower housing means with said upper housing.

13. The subsurface safety valve of claim 12 wherein the valve member is slidably mounted in the lower housing and has an external shoulder thereon and a seal bore therein below the locking recesses.

14. The subsurface safety valve of claim 13 further including variable biasing means mounted around the valve member means for biasing the valve member means to engage the valve member means external shoulder with the lower housing internal shoulder.

15. The subsurface safety valve of claim 14 wherein the biasing means includes a spring and at least one spacer ring around the valve member and between said valve member and the lower housing.

16. The subsurface safety valve of claim 14 wherein the locking mandrel has seals thereon for sealing in the seal bore below the locking recesses, and variable weight means connected on said locking mandrel.

17. The subsurface safety valve of claim 16 wherein the variable weight means comprise:
(a) a rod having grooves there around, said rod connectible to the weight means locking mandrel; and
(b) a number of weight discs positioned on said rod by a ring in one of said rod grooves.

18. The subsurface safety valve of claim 13 wherein the means releasably connecting the lower housing to the upper housing comprises:
(a) an internal groove in the lower housing;
(b) collet fingers on the lower end of the upper housing, each said finger having a lug thereon, each said lug engageable in said housing internal groove; and
(c) an expanding surface on the seat member, said seat member releasably positioned to hold said expanding surface inside said collet lugs engaging said lugs in said internal groove and connecting said lower housing to said upper housing; and
(d) means positioning said seat member in the upper housing, said seat member moveable to a position permitting disengagement of said lugs from said internal groove disconnecting said lower housing from said upper housing.

19. A system for controlling flow through a conduit comprising:
(a) a landing nipple connected in the conduit, said landing nipple having locking recesses and a seal bore therein;
(b) valve housing means carried by a locking mandrel, said locking mandrel releasably lockable and sealingly engageable in said landing nipple locking recesses and seal bore, said valve housing means including:
an upper housing having a annular seat therein,
a lower housing having openings through the wall thereof and an internal shoulder therein, means releasably connecting said lower housing to said upper housing;
(c) valve member means slidably mounted in said lower housing, said valve member means including a valve member having valve means and an external shoulder thereon and locking recesses and a seal bore therein, said valve member means moveable by flow thereby to sealingly engage said valve means with said upper housing annular seat and prevent flow through said lower housing openings and said annular seat;
(d) variable biasing means between said valve member and said lower housing for biasing said valve member external shoulder to engage said lower housing internal shoulder; and
(e) retrievable weight means including:
a locking mandrel with seals thereon, said locking mandrel releasably lockable and sealingly engageable in said valve member locking recesses and seal bore, and
variable weight means connected on said locking mandrel.

20. The system of claim 19 wherein the means releasably connecting the lower housing to the upper housing comprises:
(a) an internal groove in the lower housing;
(b) collet fingers on the lower end of the upper housing, each said finger having a lug thereon, each said lug engageable in said housing internal groove; and
(c) an expanding surface on the seat member, said seat member releasably positioned to hold said expanding surface inside said collet lugs engaging said lugs in said internal groove and connecting the lower housing to said upper housing; and
(d) means positioning said seat member in the upper housing, said seat member moveable to a position permitting disengagement of said lugs from said internal groove disconnecting said lower housing from said upper housing.

21. The system of claim 19 wherein the variable biasing means comprise:
(a) a coil spring; and
(b) at least one spacer ring, said spring and rings mounted around the valve member between said valve member and the lower housing.

22. The system of claim 19 wherein the variable weight means comprise:
(a) a rod having grooves therearound, said rod connectible to the weight means locking mandrel; and
(b) a number of weight discs positioned on said rod by a ring in one of said rod grooves.

23. A retrievable subsurface safety valve actuated to close by flow comprising:
(a) housing means including:
a lower tubular housing connectible in a flow conduit, said housing having an internal shoulder therein;
a connector sealably connected in the upper end of said lower housing, said connector connectible in a flow conduit and having an annular seat member therein; and
(b) valve means in said housing means including:
a valve member having a sealing surface and guides thereon, said guides engageable with said housing internal shoulder, said valve member moveable by flow to sealingly engage said valve member sealing surface with said annular seat member preventing flow by said valve means and through said seat member, said valve member having retrievable weight member means releasably locked therein for predetermining the flow rate at which said valve member sealingly engages said seat member, said valve member closed to flow therethrough and having a bore therein, said bore having a no-go landing shoulder at the upper end thereof and a locking recess therein, said weight member means including a body having a fishing neck, a no-go locating surface and locking means thereon, said no-go locating surface engageable with said no-go landing shoulder and said locking means engageable in said valve member locking recess, and weight member means connected on said body including a rod, said rod having a number of weight discs mounted thereon.

24. A retrievable subsurface safety valve actuated to close by flow comprising:

(a) housing means including:

a lower tubular housing connectible in a flow conduit, said housing having an internal shoulder therein; a connector sealably connected in the upper end of said lower housing, said connector connectible in a flow conduit, said connector having an annular seat member therein; and (b) valve means in said housing means including:

a valve member having a sealing surface and guides thereon, said guides engageable with said housing internal shoulder, said valve member moveable by flow to sealingly engage said valve member sealing surface with said annular seat member preventing flow by said valve means and through said annular seat member, said valve member having retrievable weight member means releasably locked therein for predetermining the flow rate at which said valve member sealingly engages said seat member, said valve member having a flow passage therethrough, said flow passage having a no-go landing shoulder, a seal bore and a locking recess therein, said weight member means including a body having a no-go locating shoulder engageable with said no-go landing shoulder and locking and sealing means thereon, said locking means having a fishing neck, said sealing means sealingly engageable in said seal bore and said locking means engageable in said valve member locking recess, and weight member means connected on said body, said weight member means including a rod, said rod having a number of weight discs mounted thereon.

25. A system for controlling flow through a conduit comprising:

(a) a landing nipple connected in the conduit, said landing nipple having locking recesses and a seal bore therein;

(b) valve housing means carried by a locking mandrel, said locking mandrel releasably lockable and sealingly engageable in said landing nipple locking recesses and seal bore, said valve housing means including:

an upper housing having annular seat therein, a lower housing having openings through the wall thereof and an internal shoulder therein, means releasably connecting said lower housing to said upper housing said connecting means including an internal groove in the lower housing; collet fingers on the lower end of the upper housing, each said finger having a lug thereon, each said lug engageable in said housing internal groove; and an expanding surface on the seat member, said seat member releasably positioned to hold said expanding surface inside said collet lugs engaging said lugs in said internal groove and connecting the lower housing to said upper housing; and means positioning said seat member in the upper housing, said seat member moveable to a position permitting disengagement of said lugs from said internal groove disconnecting said lower housing from said upper housing.

(c) valve member means slidably mounted in said lower housing, said valve member means including a valve member having valve means and an external shoulder thereon and locking recesses and a seal bore therein, said valve member means moveable by flow thereby to sealingly engage said valve means with said upper housing annular seat and prevent flow through said lower housing openings and said annular seat;

(d) variable biasing means between said valve member and said lower housing for biasing said valve member external shoulder to engage said lower housing internal shoulder, said biasing means including a coil spring; and at least one spacer ring, said spring and ring mounted around said valve member between said valve member and said lower housing; and (e) retrievable weight means including a locking mandrel with seals thereon, said locking mandrel releasably lockable and sealingly engageable in said valve member locking recesses and seal bore, and variable weight means connected on said locking mandrel, said variable weight means having a rod with grooves therearound and a number of weight discs positioned on said rod by a ring in one of said rod grooves.

* * * * *